US006773138B2

(12) United States Patent
Coushaine

(10) Patent No.: US 6,773,138 B2
(45) Date of Patent: Aug. 10, 2004

(54) SNAP TOGETHER AUTOMOTIVE LED LAMP ASSEMBLY

(75) Inventor: Charles M. Coushaine, Rindge, NH (US)

(73) Assignee: Osram Sylvania Inc., Danvers, MA (US)

( * ) Notice: Subject to any disclaimer, the term of this patent is extended or adjusted under 35 U.S.C. 154(b) by 23 days.

(21) Appl. No.: 10/260,912

(22) Filed: Sep. 30, 2002

(65) Prior Publication Data

US 2003/0189828 A1 Oct. 9, 2003

Related U.S. Application Data

(60) Provisional application No. 60/371,015, filed on Apr. 9, 2002.

(51) Int. Cl.[7] ..... H01R 33/00

(52) U.S. Cl. ..... 362/226; 362/545; 362/547; 362/294

(58) Field of Search ..... 362/545, 516, 362/547, 294, 549

(56) References Cited

U.S. PATENT DOCUMENTS

| | | | | | |
|---|---|---|---|---|---|
| 5,041,955 | A | * | 8/1991 | Devir et al. | 362/306 |
| 6,390,653 | B1 | * | 5/2002 | Schrewe | 362/374 |
| 6,499,860 | B2 | * | 12/2002 | Begemann | 362/230 |
| 2003/0063476 | A1 | * | 4/2003 | English et al. | 362/545 |

* cited by examiner

*Primary Examiner*—Allan Gariaso
*Assistant Examiner*—Ali Alavi
(74) *Attorney, Agent, or Firm*—William E. Meyer

(57) ABSTRACT

A replaceable vehicle lamp assemble may be made by placing LEDs directly on a heat conducting support that is thermally connected to an exterior heat radiating element. In one embodiment, the lamp structure is substantially snap fitted together. The LEDs are mounted on a heat conductive post and flange. A coupler encircles the post and couples through the flange to a base thereby trapping the flange in place. The coupler also includes latching features to mount in a socket hole of a reflector assembly. The heat conductive flange is then exposed on the exterior to ambient air, thereby providing cooling for the LEDs.

18 Claims, 9 Drawing Sheets

SNAP TOGETHER AUTOMOTIVE LED LAMP ASSEMBLY

The Applicant, Charles M. Coushaine, hereby claims the benefit of his provisional application Serial No. 60/371,015 filed Apr. 9, 2002 for "Snap Together Automotive Led Lamp Assembly"

1. TECHNICAL FIELD

The invention relates to electric lamps and particularly to automotive lamps. More particularly the invention is concerned with a snap together automotive LED lamp assembly.

2. BACKGROUND ART

Light emitting diodes (LEDs) can have reasonable efficiency and good life under proper conditions. They can also be enclosed in relatively small housings. These features make them attractive for automotive and other uses. The life and efficiency of an LED is related to its temperature of operation. LEDs are therefore frequently mounted singularly, in dispersed groups to reduce any local concentration of heat. Alternatively, they may be operated at less then maximum power to generate less heat. Heat reduction becomes a more significant factor when high power LED's are used. While high power LEDs can generate more absolute light, there is also more absolute heat. In generating a beam of light, such as in exterior automotive lighting, it is convenient to concentrate the light source at or near a single point. The concentrated light source can then supply a prescribed reflector or lens assembly to direct light in a prescribed manner to the field to be illuminated. In LED lamp structures, concentrating the LEDs at or near a single point generates a correspondingly concentrated supply of heat that works against the life and efficiency of the LEDs. There is then a need for an LED lamp structure that enables a concentrated LED light source, while at the same time limits the deleterious effect of high operating heat.

DISCLOSURE OF THE INVENTION

A replaceable vehicle lamp assemble may be made with an LED light source mounted on a thermally conductive structure joined to a heat-sinking element exposed to exterior air. A mechanical coupler for detachable mounting to a housing or reflector, the coupler generally faces the light source, and supports the thermally conductive structure. The coupler supports an electrical connector, and electrical connections extend from the electrical connector to the LED light source to form a replaceable lamp.

BEST MODE FOR CARRYING OUT THE INVENTION

Figure 1:
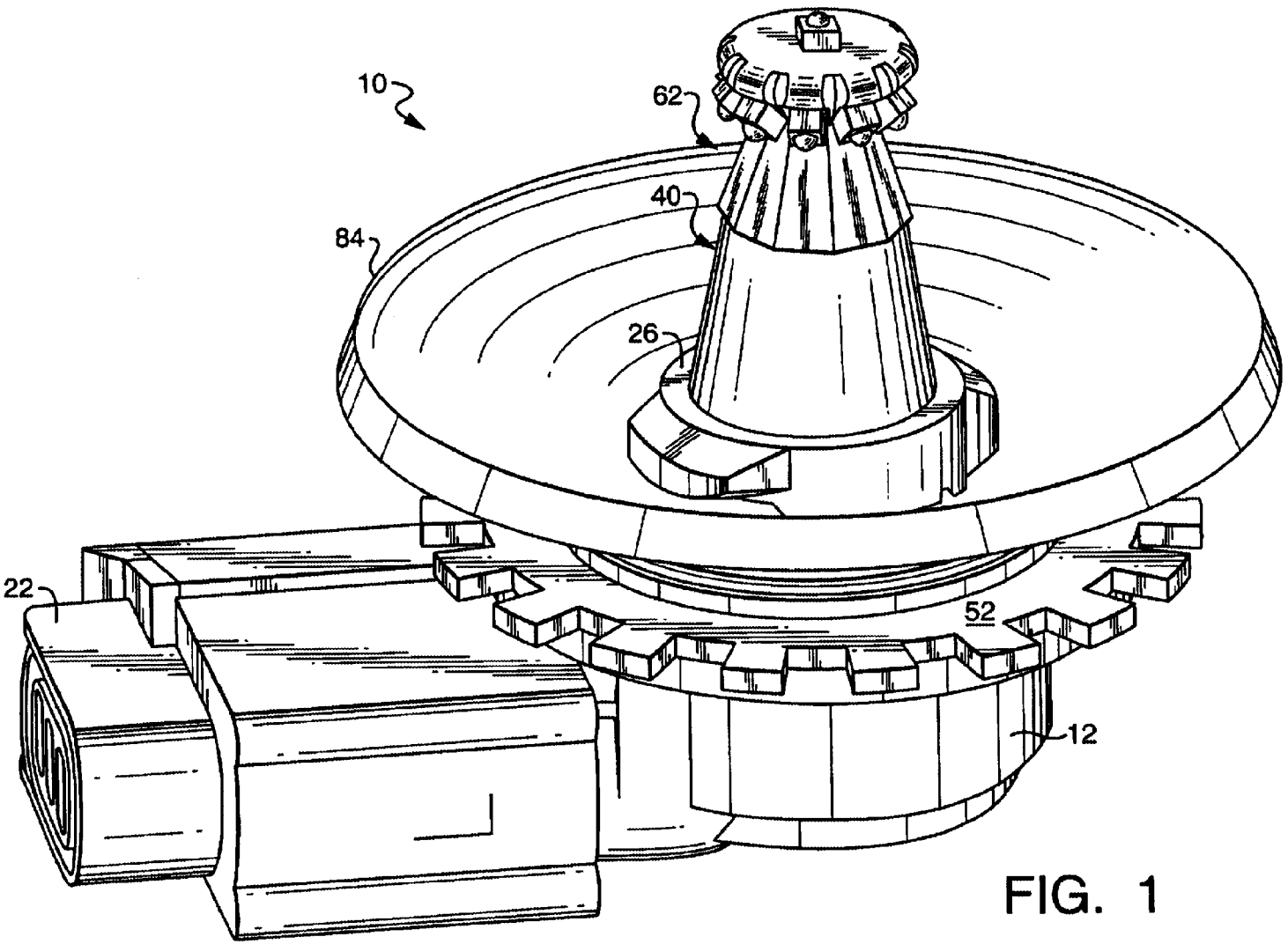
FIG. 1 shows a perspective view of an LED lamp assembly with a portion of a reflector and an electrical supply coupling.
Figure 2:
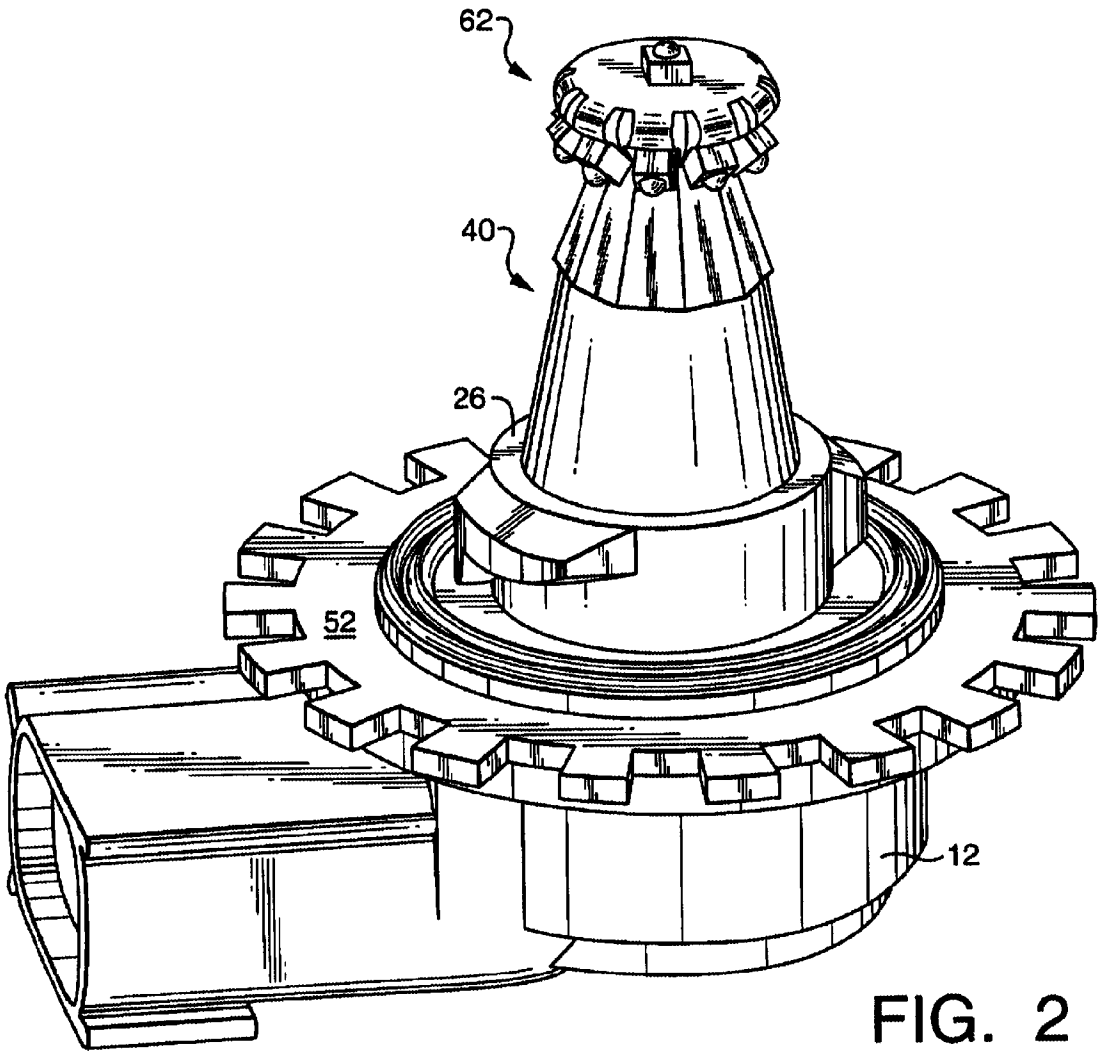
FIG. 2 shows a perspective view of a replaceable LED lamp assembly.
Figure 3:
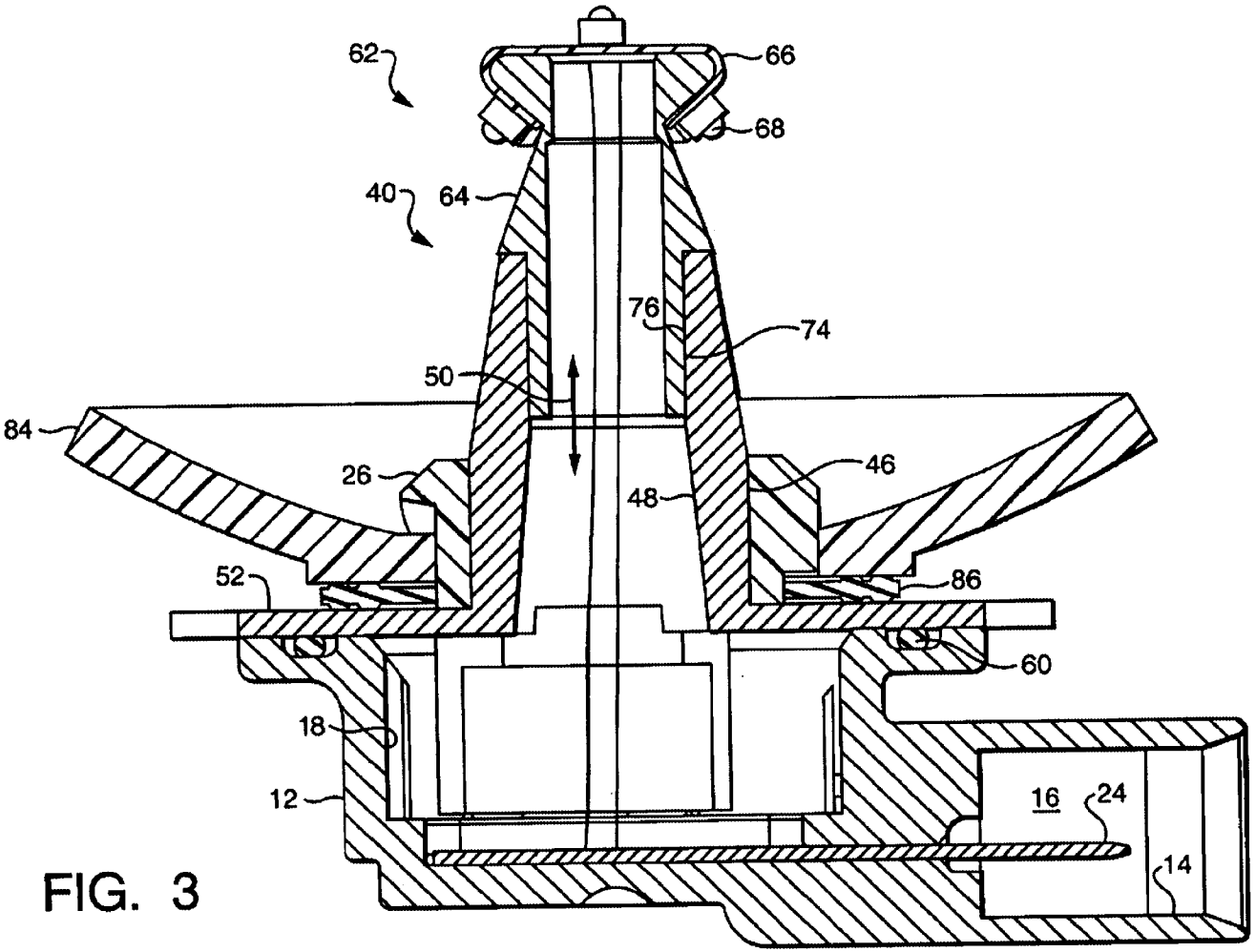
FIG. 3 shows a cross sectional view of an LED lamp assembly with a portion of a reflector.

FIG. 1 shows a perspective view of an LED lamp assembly 10 with a portion of a reflector 84, and the end sleeve 22 of a standard automotive electrical coupler. FIG. 2 shows a perspective view of an LED lamp assembly 10 without the reflector portion or end sleeve 22. FIG. 2 then shows a replaceable lamp unit. FIG. 3 shows a cross sectional view of an LED lamp assembly 10 with part of a reflector 84. A replaceable vehicle lamp assemble 10 can be formed with a base 12, a coupler 26, adapter 40, and lamp 62. The preferred base 12 is molded from plastic resin and has a first wall 14 defining a recess that acts as first receptacle 16 for electrical connection. A second wall 18 defines a recess formed to act as a second receptacle 20. The interior surface of the second receptacle 20 includes a latching feature 22. The latching feature 22 may be a protrusion, or a recess according to design choice. The preferred latching feature 22 is an upstanding post extending from the second wall 18. The base 12 includes at least one electrical connection 24 that extends from the first receptacle 16 to the second receptacle 20. The preferred electrical connection structure comprises two lugs molded in the plastic base. The lugs may be used as plug connectors in the first receptacle 16, and as weld points in the second receptacle 20.

Figure 4:
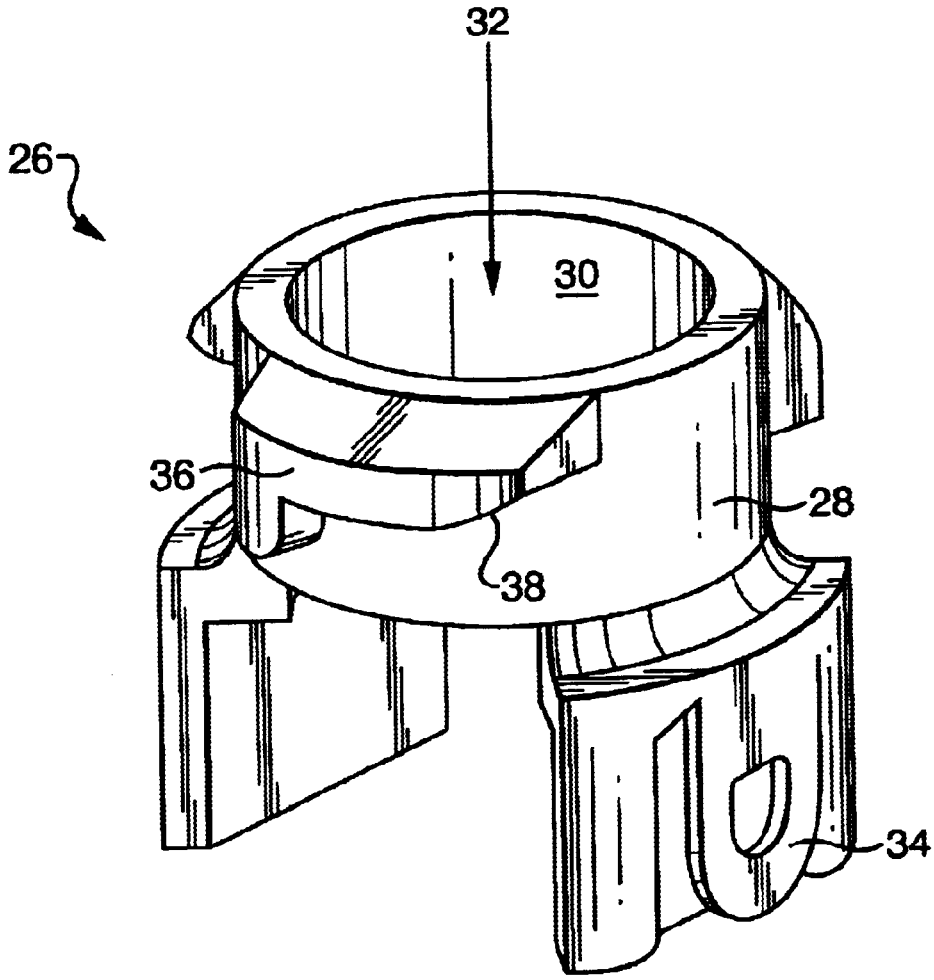
FIG. 4 shows a perspective view of a coupler.
Figure 5:
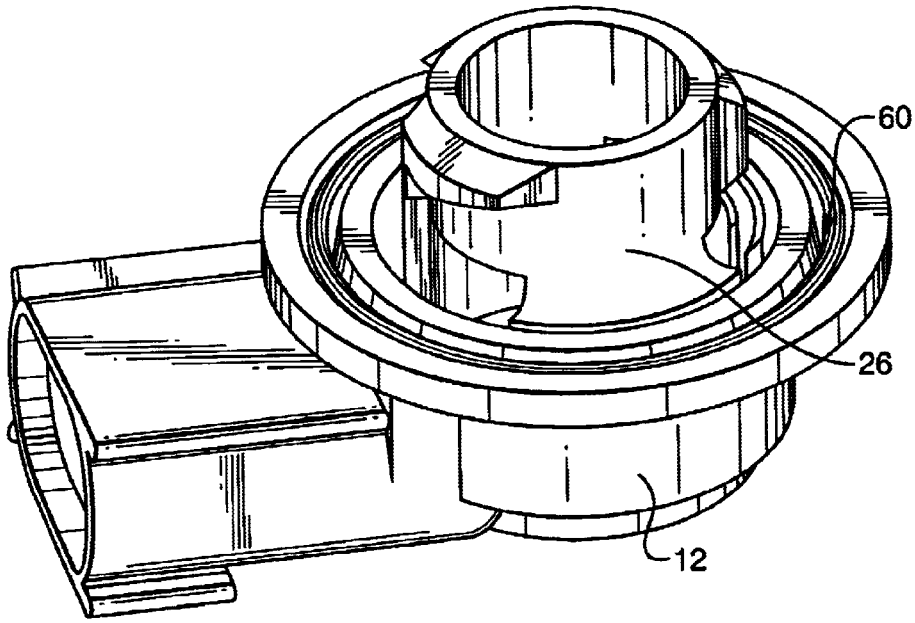
FIG. 5 shows a perspective view of a base coupled to a coupler.

FIG. 4 shows a perspective view of a coupler 26. The coupler 26 generally has a tubular portion 28 with an interior wall 30 defining a central passage 32. Extending from the tubular portion 28 is a first latching feature, such as a first arm 34 that is sized and shaped to cooperatively latch to the latching feature 22 in the base 12. The base 12 and coupler 26 are formed to fit snuggly one to the other along adjacent surfaces. The base 12 and the coupler 26 may then be snapped together, mating the base latching feature 22 and the coupler's first latching feature, such as the first arm 34. The base 12 and couple 26 may also be keyed one to the other for proper orientation. The preferred coupler 26 additionally includes a second latching feature to detachably couple to a housing or reflector opening. The lamp assembly may then be replaceably joined to a housing or reflector. The preferred second latching feature is one or more second arm(s) 36 supporting axially facing camming face(s) 38. The preferred coupler 26 then has a bayonet coupling with several bayonet arms having camming surfaces to mate in a reflector opening. The second arm 36 or arms as the case may extend radially relative to the tubular portion 28. The coupler 26 can then rotationally latch to a housing or reflector assembly. FIG. 5 shows a perspective view of a preferred base coupled to a preferred coupler without the adapter. FIG. 5 exposes the coupling relation between the base 12 and coupler 26 while excluding the flange 52 and reflector 84 portions.

Figure 6:
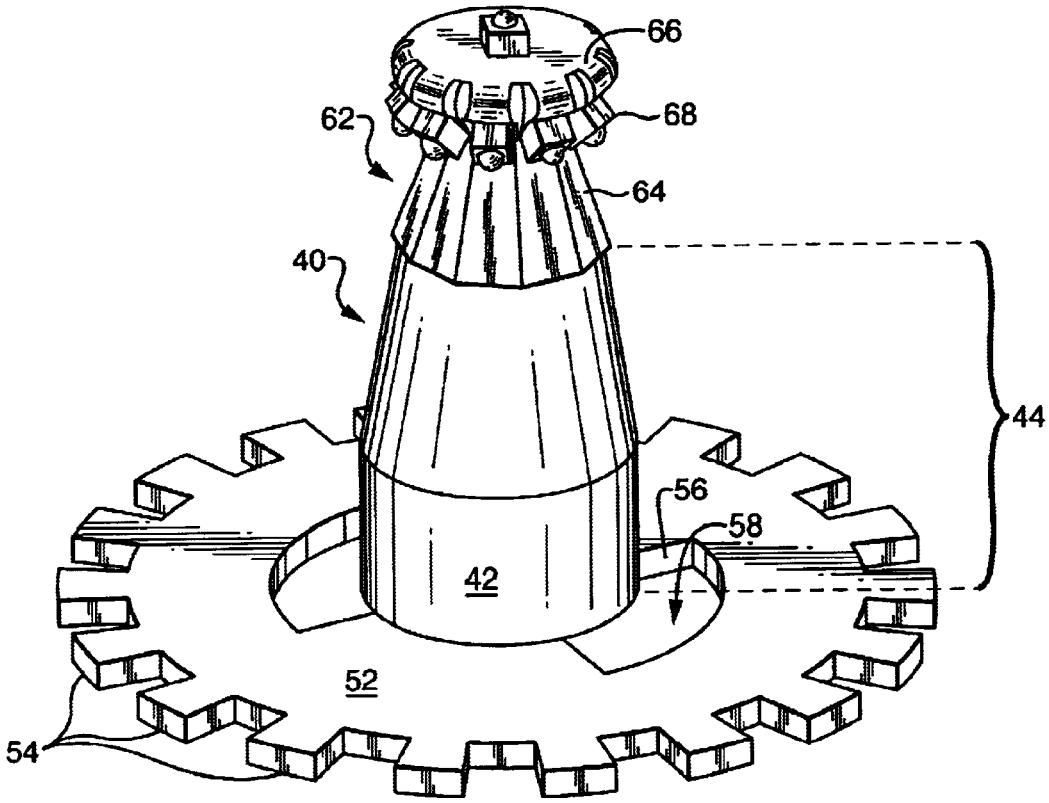
FIG. 6 shows an upper perspective view of an adapter and an LED lamp.

FIG. 6 shows an upper perspective view of an adapter 40 and a lamp 62. The preferred adapter 40 has a tubular portion 42 with an axial dimension 44 directed away from the base 12. The axial dimension 44 may be conveniently set for optical design purposes. The adapter 40 also has an exterior wall 46, and an interior wall 48 defining an internal passage 50. The tubular portion is designed to have good thermal conductivity, and is thermally connected to a thermally conductive piece with a surface exposed to air on the exterior of the lamp assembly. The preferred pieces should allow substantial heat conduction from the LEDs to the heat sink, of about 10% or more of the heat generated by the LEDs. Preferably the exposed surface is a metal sheet portion exposed on two sides to exterior air. In one embodiment, extending radially from the tubular portion 42 is a flange 52. In the preferred embodiment the flange 52 has the form of a disk extending radially away from the axis of the tubular portion 42. To enhance radiation of heat, the preferred flange 52 includes radiation or airflow features such as extended fingers, holes, flutes, ribs, or similar heat dissipating features as known in the art. Extended fingers 54 are shown as an example. Extending the flange 52 edge to where air currents are likely is suggested. The preferred adapter 40, including the flange 52 is formed from a material with high heat conductivity. Copper, die cast aluminum, or zinc or similar metals and constructions maybe used to form the adapter 40 and flange 52 structures, either as a single body, or as coupled pieces.

Figure 7:
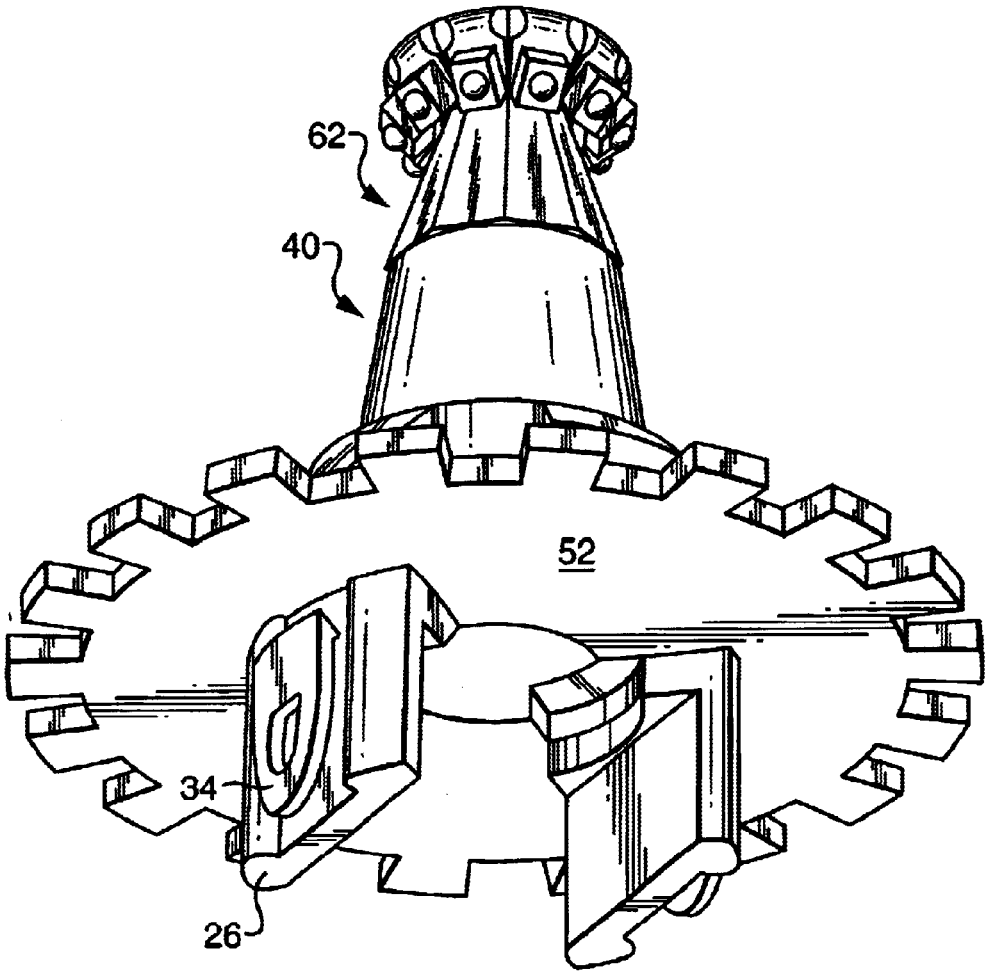
FIG. 7 shows a lower perspective view of a coupler, adapter and LED lamp assembly.

The flange 52 is further formed with a wall 56 defining a coupling passage 58. The coupling passage 58 is sized and shaped to permit the insertion and passage of at least a portion of the first arm 34 of the coupler 26. The central passage 32 of the coupler 26 may be sized and shaped to snuggly fit over the tubular portion 42 of the adapter 40. The tubular portion 30 of the coupler 26 is then positioned around the adapter 40, so the first arm 34 of the coupler 26 extends through the coupling passage 58. With the coupler 26 and the adapter 40 locked together, the first latch arm 34 is inserted into second receptacle 20 to latch with the base 12. The adapter 40, including the flange 52, is then trapped between the base 12 and the coupler 26. FIG. 7 shows a lower perspective view of a coupler 26, adapter 40 and a lamp 62. The coupler 26 encircles the adapter 40, and two first arms 34 extend through two coupling passages 58 ready to be coupled in the base 12. In a less preferred form, the coupler 26 and flange 52 may be formed so that the two rotationally latch one to the other while the first coupler arm 34 extends through the coupling passage 58. This can be done with a bayonet like latch.

A compressible seal 60 may be positioned between the base 12 and the adapter 40, such as along the flange 52. An O-ring or flat ring may be held in a groove formed in either the base 12 or the flange 52 as the case may be to encircle the passage for the electrical connections to the LED light source. Sealing may otherwise be completed as known in the art.

The LED lamp 62 is supported on a distal end of the adapter 40. The lamp 62 may comprise a lamp body 64 and an LED holder 66 supporting one or more LEDs 68. At least one electrical, but preferably two electrical connections 70, 72 extend from the LEDs through the internal passage 50 of the adapter 40, the internal passage 32 of the coupler 26 to connect with the electrical connector 24 or connectors, as the case may be in the second receptacle 20. The adapter 40 and the lamp body 64 are mounted one to another. The preferred adapter 40 and the lamp body 64 include corresponding adjacent and conformal surfaces that may be butted one to the other for secure and accurate positioning of the lamp 62 and for good thermal conduction from the lamp 62 to the adapter 40. For example, the surfaces may be closely fitting interior and exterior surfaces 74, 76 enabling an axial coupling between the adapter 40 and the lamp 62. A telescoping coupling is shown, but a threaded or similar coupling could be used. The adapter 40 and the lamp 62 may be soldiered, glued or similarly joined along the adjacent surfaces to enhance positioning or thermal conduction. The abutting coupling then provides a thermally conductive path between the two pieces. The preferred adapter 40 and the adjacent lamp 62 surfaces are respectively formed from materials with high heat conductivities, such as copper, aluminum, zinc or other metals. In combination they provide a good heat conductive path from the lamp 62 to the adapter 40 and flange 52 where the heat may be exhausted on the exterior side of the lamp assembly.

Figure 8:
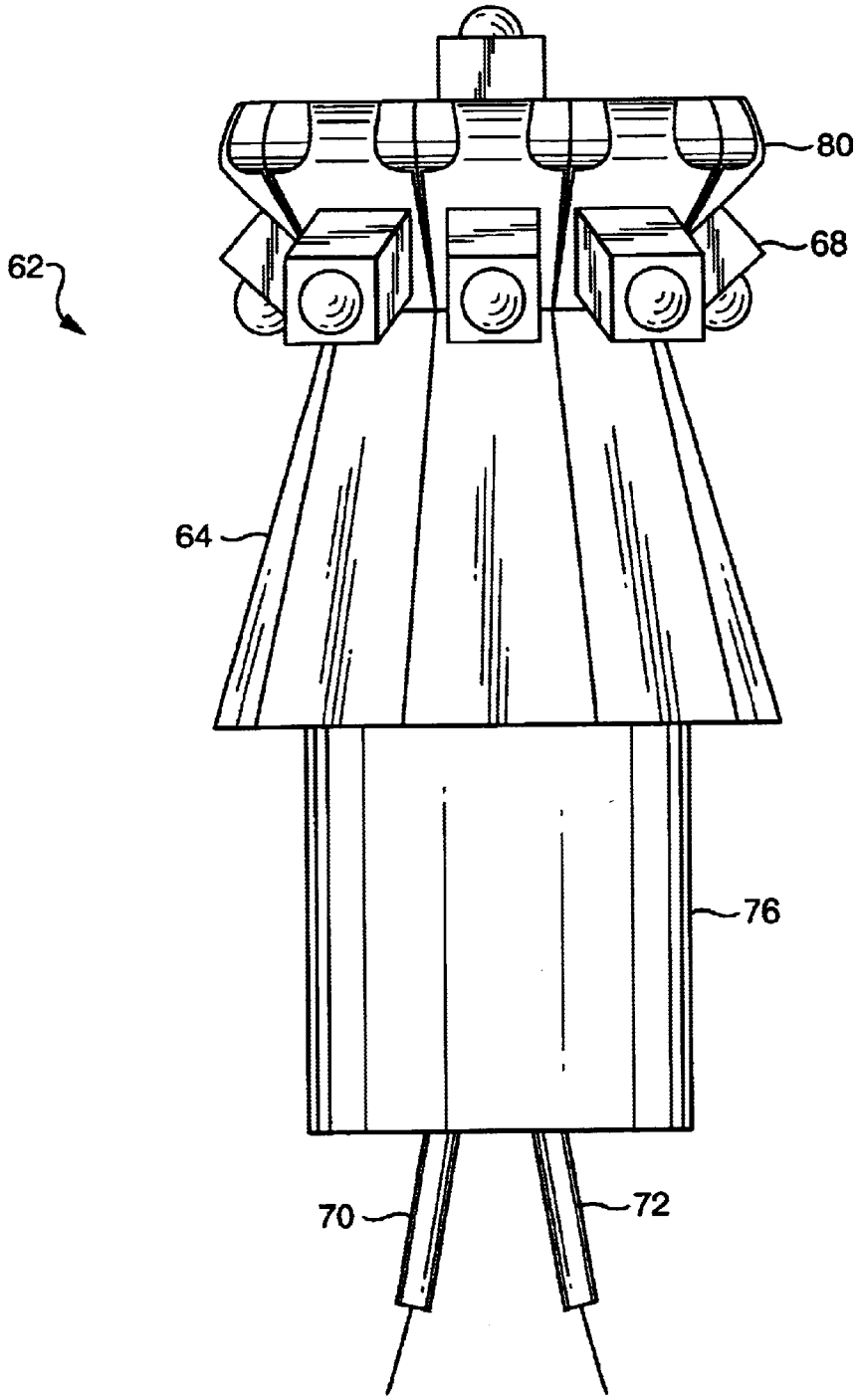
FIG. 8 shows a lamp supporting LED light sources.

FIG. 8 shows a lamp 62 mounted with LEDs 68. The preferred lamp 62 supports a population of LEDs and appropriate electrical circuitry. For heat conduction from the LED chip to the heat conductive structure, it is preferred to mount the LED chip directly on the heat conductive structure. This can be done in a variety of ways using alternating and insulating layers forming circuit patterns adjacent or underlying the LED chips. Bridge wires between regions complete the circuits either as series (preferred) or parallel arrays of LED chips on board the heat conductive structure. In the preferred embodiment the majority of the LEDs face away from, or only indirectly face the field to be illuminated. This preferred orientation is to prevent direct viewing of the intense light sources by a human. The LED's 68 may be mounted on flex material 80 that is then bent over the mushroom like head of the lamp structure to generally face the reflector. Once the LED's are mounted on the lamp head, they may be coated with a clear, protective coating 82 as is known in the art.

The lamp assembly is coordinated to function with a reflector. The assembly may be latched to a reflector 84 by way of the camming surfaces or bayonet arms of the coupler. For example, the reflector 84 may be held to the assembly 10 by the coupler 26 using at least in part by the camming face 38 of the coupler 26. An exterior wall of the coupler 26 or of the adapter 40 may be used to help locate and position the lamp assembly 10 with respect to the reflector 84. An O-ring or flat seal 86 may be positioned between the reflector 84 or general lamp housing as the case may be and a convenient portion of the lamp assembly, such as one side of the flange. The seal 86 then encircles lamp assembly including the heat conducting structure to help prevent dirt and water from affecting the reflector or lamp housing.

Figure 9:
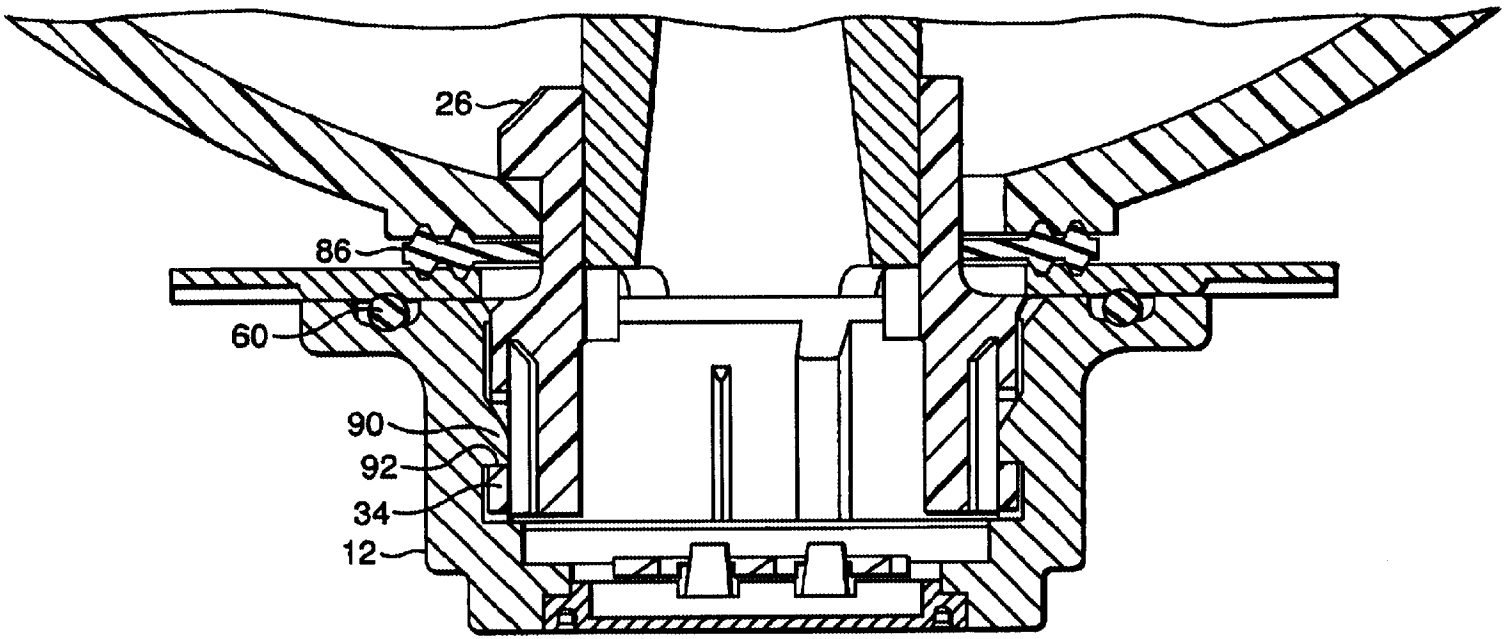
FIG. 9 shows a cross sectional, partial view of the LED lamp assembly.

FIG. 9 shows a cross sectional, partial view of the LED lamp assembly. The view in FIG. 9 is transverse to the electrical connections 24. Base 12 includes in the interior wall defining the second receptacle a protrusion 90. The coupler 26 at one end may be fitted into the second receptacle 20. Arm 34 may be formed to latch with the protrusion 90, for example as a flexible arm with a hole sized and shaped to snap fit with the protrusion 90. With a mating face 92 extending 90 degrees from the base 12 wall, and a corresponding wall on the formed hole in the coupler arm 34, the snap fit is essentially permanent, and is unaffected by repeated removable couplings to the reflector 84 or lamp housing. In the preferred embodiment, two or more such latches are formed and distributed around the internal circumferences where the base 12 and coupler 26 face one another.

For product utility, the assembly may be designed with interchangeable components for rapid adaptation to differing lamp housing structures. The preferred base 12 is then a standard base for coupling with standard power supply couplers as used in automobiles or similar transportation devices. Similarly, a standard coupler 26 may be used to latch to the base 12. A standard lamp body 64 may be used to support a variety of LED holding structures. Specific adapters 40 may be designed with differing axial extensions, and flange features. The LED light source may then be set at a preferred optical depth, and differing heat loads may be accounted for. In this way, a standard basing and standard LED positioning equipment may be used in construction of the lamp assembly, but lamps with differing axial LED depths along the axis may be adjusted from model to model. For example the neck of the adapter 40 of the length of the LED support may be changed from model to model, while all the other components remain the same. The different lamps can then be used in differently designed lamp housings. For example all of the various exterior lighting elements—headlamp, fog lamp, day light running, tail lamps, turn and signal lamps, may all include the same or similar electrical attachment at one end, and the same or similar LED support and cooling features, and yet the light sources may be positioned more or less deeply in a reflector housing to match the differing, but preferred focal positions for the various lamp systems. This interchangeable positioning part then reduces over all manufacturing costs from one structure to another.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A replaceable vehicle lamp assemble comprising:

an LED light source mounted on a thermally conductive structure joined to a heat-sinking element;

a mechanical coupler for detachable mounting to a housing or reflector, the coupler generally facing the light source, the coupler providing a support for the thermally conductive structure;

an electrical connector supported by the coupler, and electrical connections extending from the electrical connector to the LED light source to form a replaceable lamp;

wherein the heat-sinking element includes a metal flange exposed on the lamp assembly exterior to exterior air at least in part on two sides of the flange; the flange being intermediate the coupler and the electrical connector with electrical connections extending through the flange.

2. The lamp assembly in claim 1, wherein the electrical connector is sealed to the thermally conductive structure to encircle the electrical connections.

3. The lamp assembly in claim 1, further including a seal adjacent and encircling the thermally conductive structure to seal between the lamp assembly and a housing or reflector when joined to the coupler.

4. The lamp assembly in claim 1, wherein the thermally conductive structure includes a tubular metal portion generally extending between a mounting for the LED light source and the heat-sinking element.

5. The lamp assembly in claim 1, wherein the coupler holds the heat-sinking element, and the coupler latches to a base, providing an electrical connector, and the assembly also includes electrical connections that extend from the electrical connector through the coupler, and through the heat-sinking element to the LED light source.

6. The lamp in claim 5, wherein the coupler includes an attachment feature to mate with the electrical connector.

7. The lamp in claim 6, wherein the attachment feature includes at least one radially extending arm with a camming face to press against an adjacent socket face of the housing or reflector.

8. A replaceable vehicle lamp assemble comprising:

a) a base having a first wall defining a first receptacle for electrical connection, a second wall defining a second receptacle including a latching feature, and at least one electrical connection extending from the first receptacle to the second receptacle;

b) a coupler having a tubular portion having an interior wall defining a central passage, a first arm extending from the tubular portion latched to the latching feature in the base; and at least a second arm having a coupling face, the second arm extending radially relative to the tubular portion;

c) an adapter having a thermally conductive tubular portion with an axial dimension, an exterior wall, an interior wall defining an internal passage, and a heat dissipating portion extending exteriorly away from the tubular portion, the heat dissipating portion having a wall defining a coupling passage, sized and shaped to permit the passage of at least a portion of the first arm of the coupler through the coupling passage, the coupler being positioned around the adapter and the first arm of the coupler extending through the coupling passage, and latched with the base in the second receptacle; thereby trapping the heat dissipating portion between the coupler and the base; and d) an electric lamp supported by the adapter, the electric lamp having at least one electrical connection extending through the adapter, and through the coupler to connect with the electrical connection.

9. The lamp assembly in claim 8, wherein the base includes an upstanding protrusion formed on the interior of the second receptacle and the coupler is latched to the upstanding protrusion.

10. The lamp assembly in claim 9, wherein the base includes a latch feature on the interior of the second receptacle and the first arm of the coupler is latched to the base in the second receptacle.

11. The lamp assembly in claim 9, wherein a compressible seal is positioned between the base and the heat-dissipating portion.

12. The lamp assembly in claim 9, wherein the heat-dissipating portion includes heat radiation features.

13. The lamp assembly in claim 9, wherein the coupler includes a bayonet coupling supporting a camming feature.

14. The lamp assembly in claim 9, wherein the adapter and heat dissipating portion are formed from a metal material with high heat conductivity.

15. The lamp in claim 9, wherein the adapter and the lamp are snuggly mounted one to another along adjacent and conformal surfaces providing thermal conducting there between, and the coupler and the adjacent lamp surface are respectively formed from materials with high heat conductivities thereby providing a heat conductive path from the lamp to the flange.

16. The lamp in claim 9 wherein the adapter and the lamp include corresponding interior and exterior surfaces enabling an axial coupling between the adapter and the lamp.

17. The lamp in claim 16, wherein the axial coupling is a telescope like coupling.

18. A replaceable vehicle lamp assemble comprising:

a) a base having a first wall defining a first receptacle for electrical connection, a second wall defining a second receptacle including a latching feature, and at least one electrical connection extending from the first receptacle to the second receptacle;

b) a coupler having a tubular portion having an interior wall defining a central passage, a first latching feature formed to cooperatively couple to the latching feature of the base; and a second latching feature formed to detachably couple with a housing or reflector;

c) an adapter having a tubular portion with an axial dimension, an exterior wall, and an interior wall defining an internal passage; the adapter having a flange portion extending radially from the tubular portion, the tubular portion and flange being formed from a material with a high heat conductivity, and the tubular portion and the flange portion being in substantial thermal conductive contact one to the other; the flange portion having a wall defining a coupling passage, sized and shaped to permit the mechanical connection between the latching feature of the base and the first latching feature of the coupler; the coupler being positioned around the adapter and the latching feature of the base latched to first latching feature of the coupler thereby trapping the flange between the coupler and the base;

d) a compressible seal being positioned between the base and the flange; and e) an electric lamp supported by the adapter, having at least one electrical connection extending through the internal passage of the adapter, and the internal passage of the coupler to connect with the electrical connection in the second receptacle; the adapter and the lamp mounted one to another, the adapter and the lamp include corresponding, adjacent and conforming surfaces enabling coupling between the adapter and the lamp while providing substantial thermal conduction there between, and the coupler and the adjacent lamp surface are respectively formed from materials with high heat conductivities thereby providing a heat conductive path from the lamp to the flange; and f) the lamp includes a lamp body with one or more LEDs mounted on the lamp body to conduct heat from the one or more LEDs during operation to the lamp body.

* * * * *